United States Patent [19]

Rump

[11] 4,294,637

[45] Oct. 13, 1981

[54] PROCESS FOR MANUFACTURE OF A WIDE PATTERNED BAND SUCH AS A TRANSFER-CARRYING SHEET AND FOR PRINTING ON A SUBSTRATE THEREWITH

[75] Inventor: Björn S. Rump, Le Rossignol, Vandoeuvres, Switzerland, 1253

[73] Assignee: Björn Sigurd Rump, Switzerland

[21] Appl. No.: 862,834

[22] Filed: Dec. 21, 1977

Related U.S. Application Data

[60] Division of Ser. No. 598,545, Jul. 23, 1975, abandoned, which is a continuation of Ser. No. 893,289, Apr. 5, 1978, abandoned, which is a continuation of Ser. No. 961,231, Nov. 16, 1978.

[30] Foreign Application Priority Data

Jul. 31, 1974 [CH] Switzerland ..... 10568/74

Jul. 31, 1974 [CH] Switzerland ..... 10570/74

[51] Int. Cl.[3] ..... B44C 1/16; B41M 5/26; B31F 5/00; B65H 69/02

[52] U.S. Cl. ..... 156/157; 8/467; 8/471; 101/470; 156/238; 156/259; 156/264; 156/277; 428/58; 428/914

[58] Field of Search ..... 156/235, 238, 240, 256, 156/259, 265, 260, 277, 324, 157, 159, 543, 544, 545, 264; 428/57, 58, 61, 914; 101/470; 8/467, 469, 476, 471

[56] References Cited

U.S. PATENT DOCUMENTS

| | | | |
|---|---|---|---|
| 1,147,920 | 7/1915 | Bechman | 101/219 |
| 1,256,433 | 2/1918 | Blomberg | 156/235 |
| 1,431,454 | 10/1922 | Bechman | 101/219 |
| 2,558,791 | 7/1951 | Smith et al. | 156/277 X |
| 2,600,284 | 6/1952 | Tranter | 156/277 UX |
| 2,628,929 | 2/1953 | Persoon et al. | 156/240 X |
| 3,211,603 | 10/1965 | Kaehler | 156/240 X |
| 3,275,465 | 9/1966 | Rathke et al. | 428/914 X |
| 3,661,664 | 5/1972 | Lundell | 156/277 X |
| 3,773,598 | 11/1973 | Taeffner et al. | 156/545 X |
| 3,841,944 | 10/1974 | Harris, Jr. | 156/159 X |
| 3,915,628 | 10/1975 | Bossard | 101/470 X |
| 3,924,532 | 12/1975 | Hubbard et al. | 101/219 X |
| 3,992,988 | 11/1976 | Dwyer | 101/9 |
| 3,994,250 | 11/1976 | Norris | 101/470 X |
| 4,008,661 | 2/1977 | Mathis | 101/219 X |
| 4,089,722 | 5/1978 | Holoubek | 428/914 X |

FOREIGN PATENT DOCUMENTS

| | | |
|---|---|---|
| 2390294 | 12/1978 | France . |
| 1032813 | 6/1966 | United Kingdom . |
| 1338475 | 11/1973 | United Kingdom . |
| 1343927 | 1/1974 | United Kingdom . |

*Primary Examiner*—William A. Powell
*Assistant Examiner*—Thomas Bokan
*Attorney, Agent, or Firm*—Ostrolenk, Faber, Gerb & Soffen

[57] ABSTRACT

A wide composite band of a patterned transfer-carrying sheet is formed of several webs or web sections secured together parallel or perpendicular to the band with the patterns of adjacent webs or web sections in registration. Webs may for example be fed side-by-side parallel to one another and any staggering of the pattern corrected by suitable adjustment of web tensioning rollers by detecting reference marks corresponding to the pattern. The webs are then joined by sticking, or could be directly used for transfer printing without being secured together. Alternatively, a web is fed perpendicular to the band being formed, and cut into sections which are adjusted relative to the band by detecting reference marks, and joined to the band.

16 Claims, 24 Drawing Figures

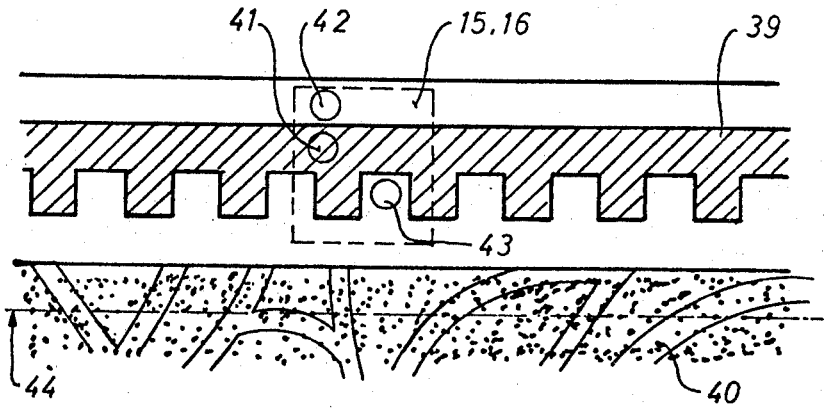
FIG. 4
FIG. 6
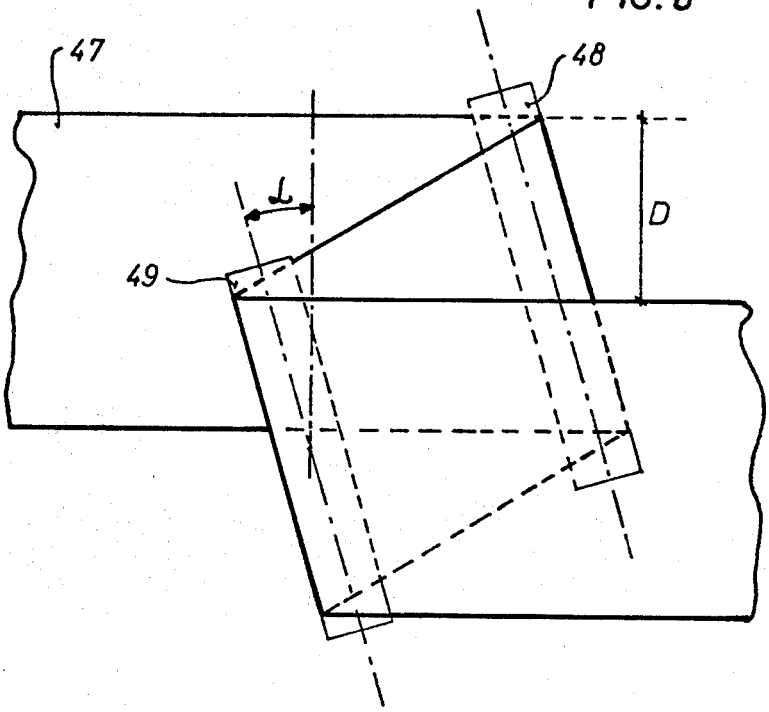

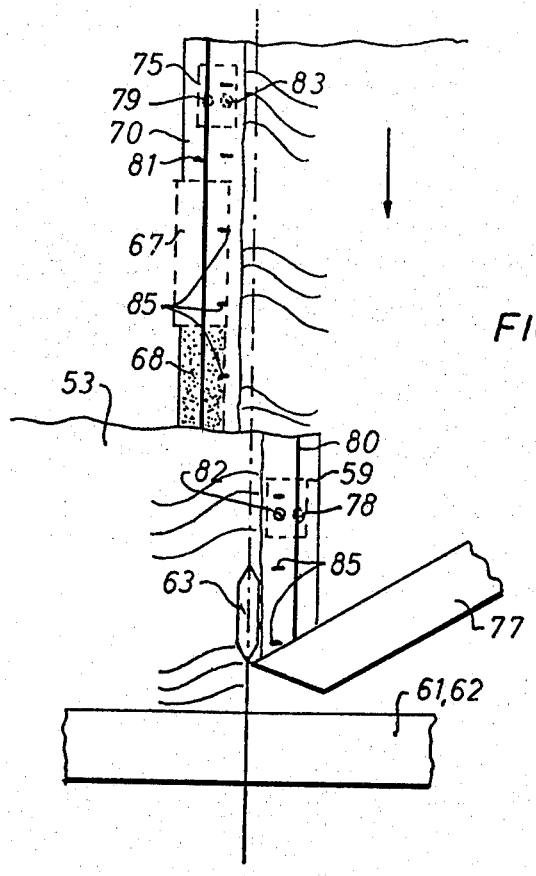
FIG. 8
FIG. 9
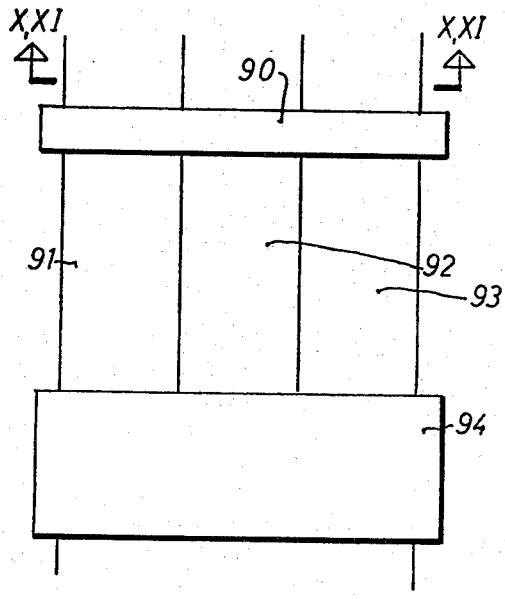
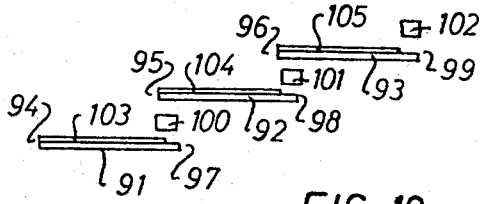
FIG. 10
FIG. 11
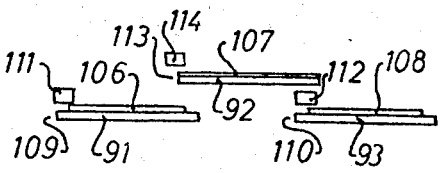

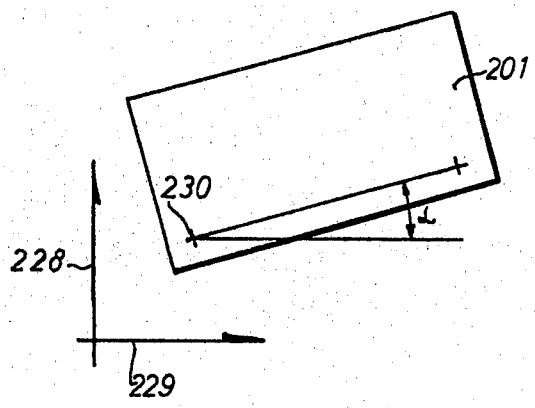
FIG. 16
FIG. 17
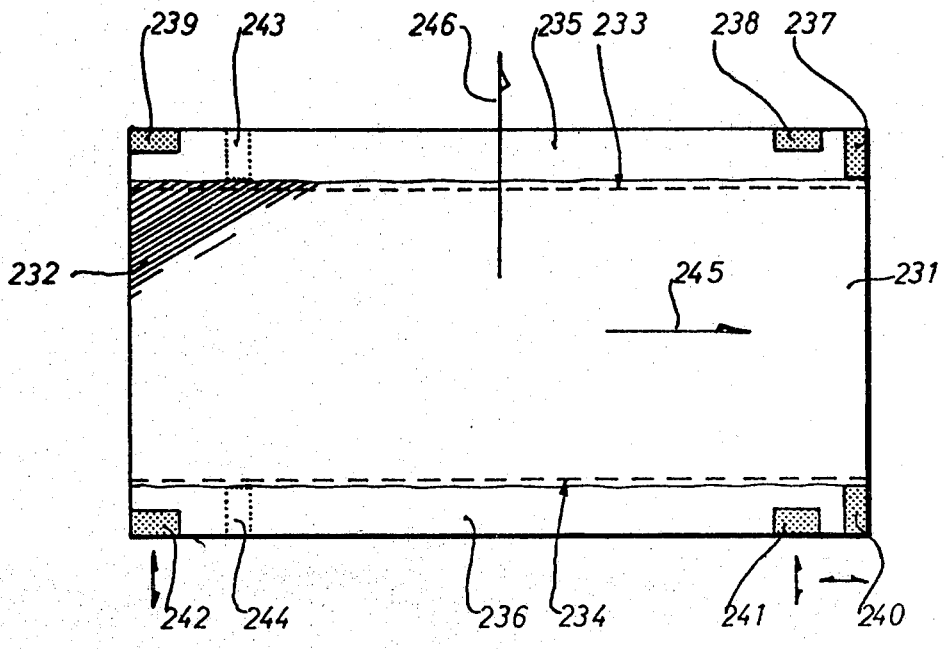

FIG. 23
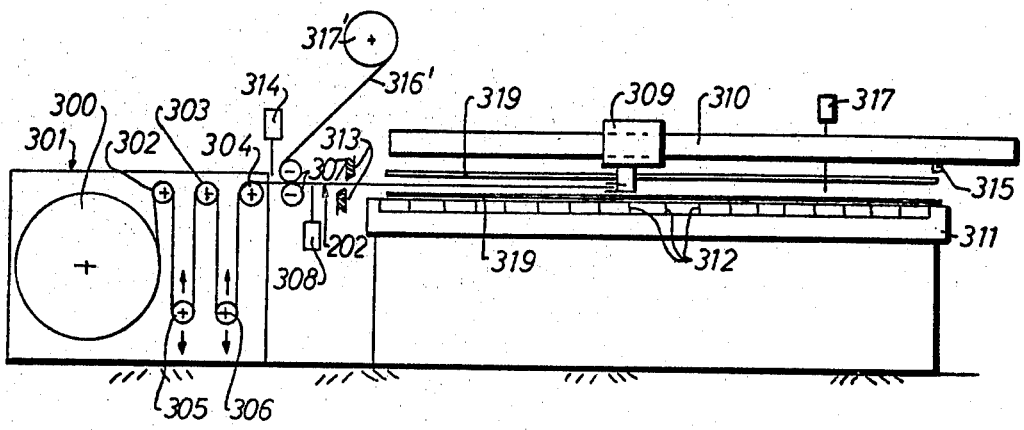
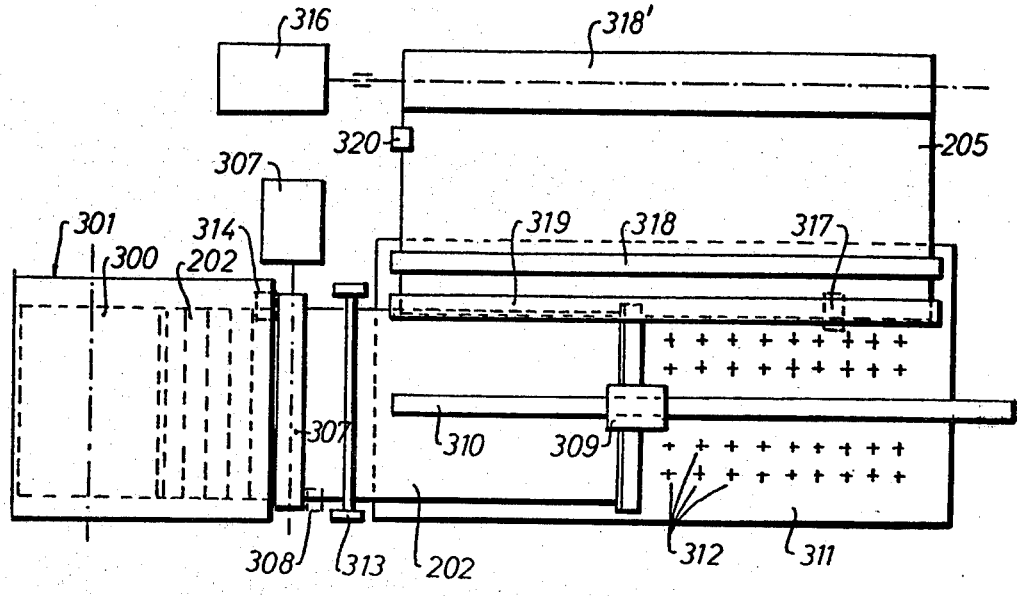
FIG. 24

PROCESS FOR MANUFACTURE OF A WIDE PATTERNED BAND SUCH AS A TRANSFER-CARRYING SHEET AND FOR PRINTING ON A SUBSTRATE THEREWITH

RELATED APPLICATIONS

This is a divisional of U.S. patent application Ser. No. 598,545, filed July 23, 1975, now abandoned in favor of continuation U.S. application Ser. No. 893,289 filed Apr. 5, 1978, now abandoned in favor of continuation U.S. application Ser. No. 961,231 filed Nov. 16, 1978.

BACKGROUND OF THE INVENTION

The invention relates to a process and machine for producing wide bands of patterned flexible sheet material from patterned webs of lesser width (for example having a standard width between 79 and 205 cm), as well as to wide bands obtained by this process, in particular wide transfer-carrying sheet for transfer printing.

Processes for the printing of textiles and plastics materials using transfer sheets have been known for many years. In these processes, the pattern is printed on a web of synthetic paper, non-woven fabric, synthetic material, metal or, most usually, paper, so that it can later be transferred by heat printing, decalcomania etc. onto the textile or plastics material to be printed. The transfer-supporting web is in general brought into contact with the surface to be printed and passed between two cylinders at least one of which is heated. Transfer takes place above a given temperature. In certain types of transfer, only the colorants are transferred; in others, the entire imprint formed of a binder-colorant composite is transferred. It is sometimes necessary to operate in the presence of water or another liquid, water vapor or an organic solvent.

The printing machines available on the market enable the printing of webs having a width of up to 1.60 meters normally, or 2 meters at most. A width of 1.60 meters is sufficient for the printing of textiles used, for example, for clothing; however, it is quite insufficient for the printing by transfer of textiles, non-woven fabrics, or synthetic materials used for decoration or furnishing, for example carpets, moquettes, plastics materials (such as in vinyl or polyurethanes) for floor coverings, or sheets of plastics material for decoration, for which widths of 4 to 5 meters are necessary.

The difficulties in placing a pattern on a large-width web are well known to persons skilled in the art, as is the high cost of the operation. It is for example conceivably possible to construct machines for printing transfer webs with a width of four to five meters. The cost price of such machines is, however, so high that they are an economically unrealistic proposition.

An aim of the invention is to provide a process and a machine for producing patterned bands, in particular transfer-supporting or "decal" sheets, having a width of at least 2 to 6 meters, using available printing of other machines for the application of patterns with a width of no more than two meters, for example machines with printing cylinders of up to two meters long.

The process according to the invention is characterized in that webs or web sections provided with a same pattern are brought together side-to-side, the relative positions of the webs or web sections are set by detecting reference marks to bring patterns of adjacent webs or web sections into register, the edge of at least one of the webs or web sections possibly being cut after location of the reference marks and before or after setting relative positions of the webs or web sections and, in the case where the large-width band is to be stored before use, the thus-provided joint is permanently secured, for example by sticking or by welding.

In a variation of the process, the joint is provided parallel to the edges of the composite band. For example, at least two adjacent webs are continuously fed parallel to one another while holding them under a predetermined tension, and the tension of one of the webs is continuously adjusted on the basis of the detection of the reference marks in a manner to take up any staggering of the pattern. In general it is also possible to provide a lateral correction by means of appropriate references marks. The width of the large band formed in this manner is thus the sum of the widths of the webs joined in this manner (i.e. the non-overlapping parts, when an overlapping joint provided).

In another variation, the joints are arranged perpendicular to the edges of the formed band. It is thus possible to use only a single initial web which is fed perpendicular to the band being formed, and successively cut off sections of the initial web, preferably after location of the reference marks, the length of the sections corresponding to the width of the composite band. Of course, several initial webs could also be assembled in a similar manner. When the pattern is applied to the initial webs, even with the greatest care, there may be a difference of tone or shape from one edge to the other. Although such a difference is small, it could become visible when one edge of one web section is placed beside the other edge of another web section. Instead, alternate web sections can be fed in opposite directions; hence said one edge of one section will always be beside the corresponding one edge of another section.

The installation for carrying out the process comprises means for bringing webs of web sections side-by-side, and means for detecting reference marks and for controlling the relative positions of the webs or web sections to bring their patterns into register. It may also comprise means for cutting the webs or web sections after or before setting of their positions, as well as further means for sticking or welding the joints.

In a first embodiment, the means for bringing the webs side-by-side comprise, for each web, a pair of rollers arranged to place it under tension and a pair of driving rollers common to two webs and placed downstream of the tensioning rollers in the direction of feed of the webs for driving the webs at a predetermined constant speed; the means for detecting reference marks and for controlling the webs are arranged to control the web-tensioning rollers in a manner to continuously adjust the relative position of the webs to take up staggering of the pattern. These means may be arranged either to detect a lateral displacement of a web and control a compensating displacement in the opposite direction of at least one of the pairs of tensioning rollers, or to detect an advance or lag of one web relative to the other and control at least one of the pairs of tensioning rollers to vary the tension of at least one web with an advance or a lag, in order to take up this advance or lag, or may combine both of these arrangements.

In general, the tensioning rollers initially tension the webs with an average tension which is the arithmetic mean of a predetermined maximum tension below the breaking tension of the web and a minimum tension for which the web still has a substantially rectilinear profile.

One may for example proceed by increasing the tension of the web which has an advance, or reducing the tension of the other web (in particular when the tension rollers apply to the web which has an advance a tension close to the breaking tension).

The detection means may be connected to an electronic control circuit arranged to increase or decrease the tension of one web and simultaneously decrease or increase the tension of the other web, so that the variation of tension for each web is as small as possible. It is possible to arrange for a signal to be given when a maximum limiting tension (breaking tension) or a minimum limiting tension (at which the web still has a substantially rectilinear profile) is reached. The tension controlling devices may also, before giving a warning signal or stopping the machine, arrange for a complementary switching function to be carried out, as will be explained later.

When the large-width bands obtained by this first embodiment of machine are for a transfer process, it is possible to not permanently fix the joint by sticking of welding for example, but, without permanently fixing the joint, to directly feed the set and cut webs into a transfer machine with a substrate onto which the pattern is transferred.

It is clear that the basic sheet material (generally paper) of the standard-width patterned webs supplied to the above-mentioned machines must be of fairly high quality, i.e. must have a substantially constant elasticity and coefficient of thermal dilatation. The breakage tension should be sufficient to allow longitudinal compensation without rupture. The transfer paper will thus be chosen to meet these requirements. Certain precautions must also be taken when pre-printing the webs. The printing should be carried out in identical conditions (temperature, humidity, pressure, and so on) for all of the webs. Finally, the reference marks should be printed with great care and at the same time as printing of the patterns. Staggering will thus be avoided. If magnetically or pneumatically-detectable means are used as reference marks, there should be a strict control that repetitions of the pattern correspond exactly to the same reference-mark positions.

In a second embodiment of machine, the means for bringing the webs or web sections side-by-side comprise inlet conveying means feeding an initial web perpendicular to outlet conveying means for taking up the band formed from sections of the initial web, the conveying means being arranged to position, by the means for detecting reference marks, each section in relation to the end of the band on the outlet conveyor means.

The reference-mark detection and control means enable, for example, setting of the position of the end of the section to be connected to the composite band relative to points of reference by bringing reference marks on the end of the band to the reference points, and then adjusting the position of each web section by bringing the reference marks of each section to the reference points. It is also possible to cut sections with a sufficient precision relative to the pattern so that the end of a section it is desired to add to the band being formed may serve as a reference for setting of the section. The positioning of the sections as a function of the reference marks is in general provided by conveyor means comprising an appropriate device such as gripper systems or pressure or suction orifices.

Cutting of the web sections can be done before detection of the reference marks. Means for stretching the sections to take up any staggering must then be provided. However, cutting is preferably carried out after detection of the reference marks.

In all of these variations, all types of reference marks may be used: optical, preferably a visible imprint enabling both lateral and longitudinal setting, and applied simultaneously with the pattern; magnetic, such as a magnetic band or magnetic imprints; mechanical, such as perforations; or even using the pattern itself. The detection means may, as appropriate, be photo-electric, magnetic or pneumatic.

When the composite bands carry transfers for transfer printing, it is possible to install a transfer machine such as a calender following the band-producing machine. Such a combination will be described later. It is also possible to dispose the band-producing machine after apparatus, for example a printing machine, by which the pattern is applied the original webs.

The accompanying drawings show, schematically and by way of example, several embodiments of machines for producing wide composite bands according to the invention, and variations of these embodiments. In the drawings:

BRIEF DESCRIPTION OF THE DRAWINGS

For the purpose of illustrating the invention, there is shown in the drawings several embodiments which are presently preferred; it being understood, however, that this invention is not limited to the precise arrangements and instrumentalities shown.

FIG. 4 shows in detail the printed pattern and the reference imprint along an edge of a standard web;

FIG. 6 shows a pair of rollers which may be incorporated in the machine of FIG. 1 for laterally displacing a web passing between these rollers;

FIG. 8 is a diagrammatic plan view of part of FIG. 7, at the location where the webs are stuck together;

FIG. 9 is a plan view of a part of a machine in which three webs are set in relation to one another and delivered without sticking to a transfer machine;

FIGS. 10 and 11 are cross-section along line XXI—XXI of FIG. 9, showing two web-feed arrangements for the machine of FIG. 9;

FIG. 16 is a schematic view showing how the transverse conveyor of the machine of FIGS. 12 and 13 or 14 and 15 may be displaced to bring each web section to the end of the band being formed and adjust the section relative to the end of the band;

FIG. 17 is a plan view of a section of an initial web with reference imprints on its edges;

FIG. 23 is a cross-section through another variation of the machine of FIGS. 12 to 21; and FIG. 24 is a top view of the variation of FIG. 23.

DETAILED DESCRIPTION OF THE PREFERRED EMBODIMENTS

Figure 1:
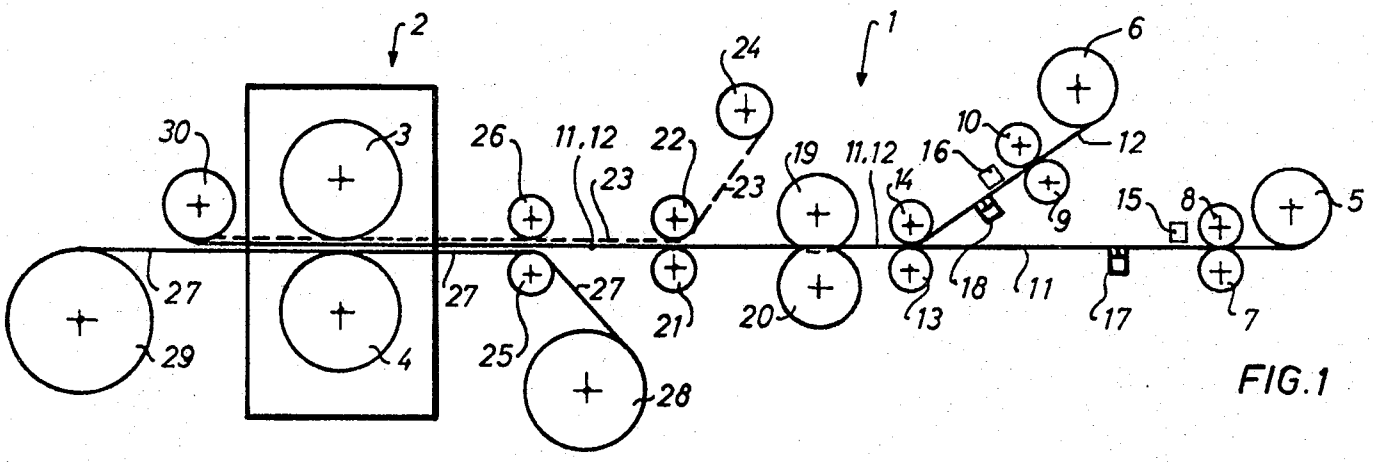
FIG. 1 is a side view of a first embodiment of a machine for placing two patterned webs side-by-side and assembling them to form a band of larger width with the pattern in register on either side of the joint; the figure also shows by way of example a transfer machine placed following the band-producing machine for the decoration of a wide substrate by heat printing with vaporizable colorants incorporated in the transfer-carrying band obtained according to the invention.
Figure 2:
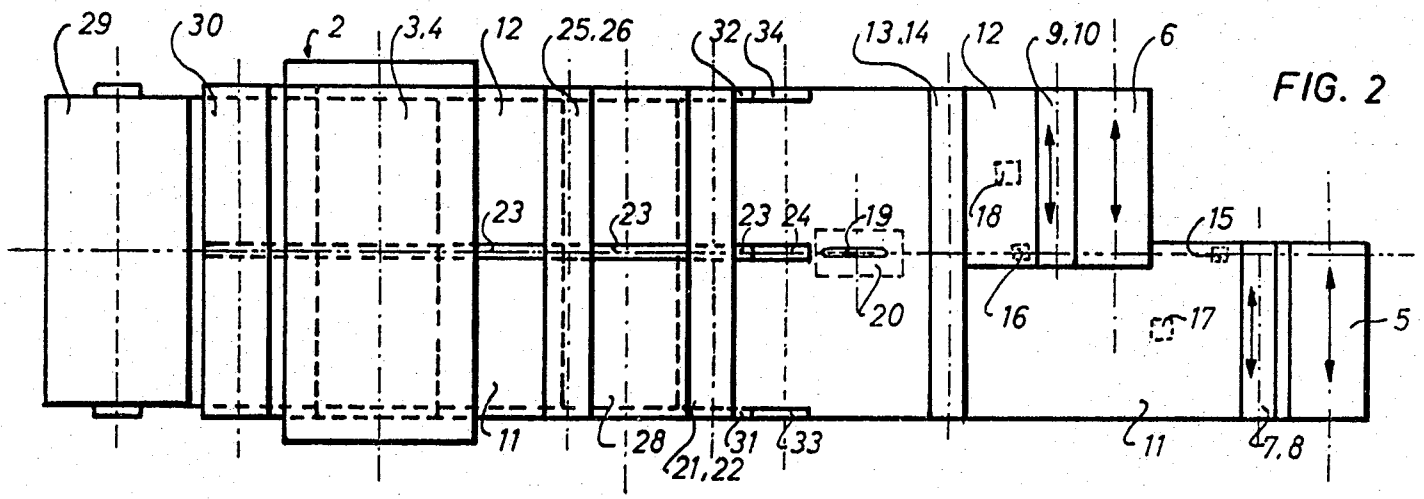
FIG. 2 is a plan view of the embodiment of FIG. 1.

With reference to FIGS. 1 and 2, the transfer machine 2 includes two cylinders 3 and 4 for pressing together transfer paper and a sheet of material 27, at a temperature of 180° to 240° C. Such transfer machines are well known to persons skilled in the art and consequently the machine 2 will not be described in detail.

Machine 1 comprises two rolls 5 and 6 feeding webs 11, 12 of standard width (generally less than 205 cm), followed by two pairs of tensioning rollers 7, 8 and 9, 10 respectively between which the webs 11, 12 from rolls 5 and 6 pass.

The webs 11 and 12 are fed side-by-side between a pair of driving rollers 13, 14 common to the two webs 11 and 12 and driving them at constant speed. Along the paths of webs 11 and 12 respectively, between the pair of driving rollers 13, 14 and the pairs of tensioning rollers 7, 8 and 9, 10, are disposed reference-mark detection devices 15, 16 and tension control devices 17, 18 respectively.

Devices 15 and 16 are electro-optical devices arranged to detect reference or guide imprints made on the webs at the same time as printing of their patterns and control the speeds of the respective pairs of rollers 7, 8 and 9, 10 as well as a lateral displacement of these rollers as a function of displacements of the guide imprints. The roll 5 and rollers 7 and 8, as well as roll 6 and rollers 9 and 10 are each mounted as a unit on a carriage (not shown) arranged to move laterally as indicated by the arrow on FIG. 2 to compensate for variations in the lateral position of each web. Also, the pairs of rollers 7, 8 and 9, 10 are arranged to be able to rotate at slightly greater or smaller speeds than the corresponding constant speed of the webs 11 and 12. It is thus possible to tension webs 11 and 12 to a greater or lesser degree, since the pair of rollers 13, 14 rotate at constant speed.

The lateral shifting and variation of the speed of the tensioning rollers will be described in detail later with reference to FIGS. 3, 4 and 5.

The tension control devices 17, 18 are security devices arranged to prevent the tensions of the webs from exceeding predetermined limits, namely a maximum tension $T_{max}$, chosen below the breakage tension, and a minimum tension $T_{min}$, chosen above the tension at which the web no longer has a substantially rectilinear profile. The devices 17 and 18 in particular enable ripping of the webs to be avoided; they may actuate an alarm system or stop the machine when the limiting tensions are reached, or actuate a complementary switching function which will be described later.

After having passed between the driving rollers 13 and 14, the webs 11 and 12, positioned side-by-side with the adjacent edges having an adjusted overlap, pass under a circular cutter 19 acting against a bearing wheel 20 for cutting and removal of the overlapping edges. After passage under cutter 19, the webs 11 and 12, having been cut together, are exactly placed together edge-to-edge along the line of cutting.

After cutter 19, the webs 11 and 12 placed edge-to-edge pass between two freely turning cylinders 21 and 22 fed with an adhesive band from a roller 24 so that the adhesive band 23 is applied against the edges of webs 11 and 12 on either side of the joint. The adhesive band is pressed by the rollers 21 and 22 against the united edges of webs 11 and 12 to firmly assemble the webs.

The adhesive band 23 is in a thin material having a coefficient of temperature dilatation substantially equal to that of the webs 11, 12. This precaution avoids puckering or folds in the wide composite band obtained, in particular when it passes between the cylinders 3, 4 of transfer machine 2.

The webs 11, 12 assembled by adhesive band 23 then pass between two driving rollers 25, 26 rotating at the same constant speed as rollers 13, 14, with sheet material 27 to be printed being fed from a feed roll 28 placed under webs 11 and 12.

At the delivery of machine 2, the printed material 27 is wound on a take-up roll 29, and the used transfer paper on a take-up roll 30.

Provision is made to apply adhesive bands 31, 32 to the outer edges of the webs 11, 12 of transfer paper by means of rollers 33 and 34, as shown in FIG. 2. The bands 31, 32 serve to improve the behaviour of the transfer paper and hence prevent the formation of folds when the paper passes between rollers 25, 26 and cylinders 3, 4.

The adhesive bands 23, 31 and 32 may be replaced by a wide web of thin paper stuck over its entire width to the transfer paper; this web could be uniformly perforated over its entire surface to reduce as far as possible the resistance to heat of the composite paper band.

The manner of registering the webs of transfer paper will now be described in detail with reference to FIGS. 3, 4 and 5.

Figure 3:
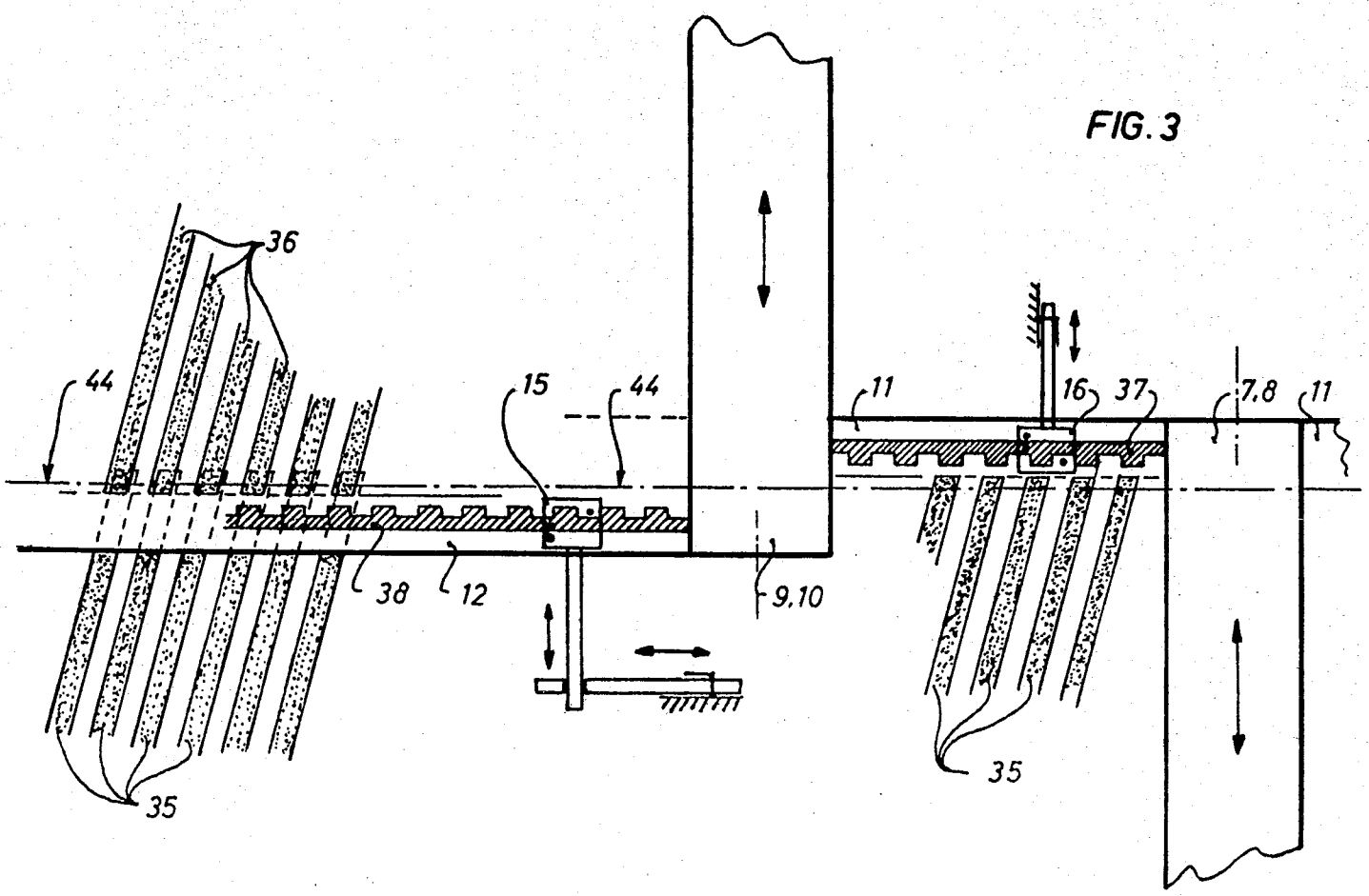
FIG. 3 is a plan view of a detail of two webs with reference imprints at their edges, illustrating a manner of registering the webs using electro-optical cells.

FIG. 3 shows web 11 with its pair of tensioning rollers 7, 8 and web 12 with its pair of tensioning rollers 9, 10; for the sake of clarity, the feed rolls 5 and 6 and the parts of webs 11, 12 leading to the feed rolls are not shown in this figure.

The webs 11, 12 of transfer paper each have a like pattern formed basically of oblique stripes 35, 36 respectively and a guide or reference imprint 37, 38 respectively. Here, the imprints 37, 38 are in the form of a strip limited on one side by a rectilinear border and on the other side by a rectangular wave. The rectilinear border of imprints 37, 38 located towards the edge of the web 11, 12 serves for the control and correction of any lateral displacement of the webs, and the discontinuous border (square wave) serves for control and correction of any longitudinal staggering of the webs. Of course, to enable the patterns to be brought into register by means of the reference imprints, the imprints 37, 38 must correspond to the pattern printed on the webs. In particular, the periodicity of the reference imprints must be equal to or a multiple of the periodicity of the pattern. In the example of FIG. 3, it can be seen that the end of each stripe 35, 36 faces a protruding part of the square wave. By exactly positioning imprints 37, 38, the stripes 35 and 36 of the pattern will also be exactly placed. Also, the imprints 37, 38 are provided in a color such as black or blue which can easily be read by photoelectric cells. The reference imprints may for example be printed during printing of the pattern using the blue component. FIG. 3 also schematically shows the register-control devices 15 and 16 which are mounted on the frame of the machine. Device 15 is mounted for adjustment along one direction, whereas device 16 is mounted for adjustment along two directions, as indicated by arrows.

As shown in FIG. 4, the register-control device 15 or 16 includes two photoelectric cells 41, 42 for following the outer edge of a reference imprint 39, and an additional cell 43 for following passage of the discontinuities of the inner part of reference imprint 39.

Cells 41 and 42 control transverse displacement, according to the arrows of FIGS. 2 and 3, of the tension rollers 7, 8 and feed roll 5, or rollers 9, 10 and roll 6, by the intermediary of an electric circuit, not shown. Cell 43 controls variations of the speed of the respective tension rollers and, since rollers 13, 14, 25, 26 and cylinders 3, 4 all turn at a constant peripheral speed, consequently also the tension of webs 11 and 12 between the previously defined limiting values $T_{max}$ and $T_{min}$. In normal operating conditions, the webs 11, 12 will have an average tension $T_m$ substantially equal to the arithmetic mean of $T_{max}$ and $T_{min}$. Only when corrections are necessary to longitudinally position the webs, do the tensions applied to webs 11 and 12 deviate from value $T_m$ between the limits $T_{min}$ and $T_{max}$.

FIGS. 3 and 4 also indicate by chain-line 44, the line of cutting of the webs 11 and 12. It is observed that the overlapping of webs 11 and 12 is arranged so that the printed patterns of the webs overlap, each extending beyond the cutting line 44. This expedient ensures that there will be no discontinuity in the pattern transferred to material 27.

The described machine operates as follows:

When webs 11 and 12 are placed in the machine, the web 12 is positioned over web 11 so that the patterns overlap and extend beyond the cutting line 44 and with stripes 36 in exact correspondence. Devices 15 and 16 are then set. For device 15 it is sufficient to arrange that its cell 41 (FIG. 4) is placed on the registering imprint 37 (FIG. 3) and cell 42 is on the outer non-printed edge of the paper, the webs being arranged to bring a gap of the square wave under cell 43 of device 16. The position of device 16 is firstly set transverse to the direction of feed until the rectilinear edge of imprint 38 (FIG. 3) is between the two corresponding cells, as described above for device 15. The device 16 is then adjusted longitudinally until its cell 43 (FIG. 4) is in the same position in relation to the gaps of imprint 38 (FIG. 3) as the corresponding cell of device 15 is in relation to the gaps of imprint 37. In the example of FIG. 3, the cells 43 of the two devices are momentaneously exactly between two square parts of the imprints.

Once this adjustment is completed, the roll of material 28 to be printed is placed in the machine, and the web of this material is passed about roller 25 and through the transfer machine 2 to be taken-up by its roll 29, and the machine is started.

Let us suppose that during operation web 11 becomes laterally staggered in relation to its normal feed, due to a dilatation of the paper or an irregular winding of the paper on roll 5. This staggering will immediately be read by photoelectric cells 41 and 42 (FIG. 4) of device 15 which controls via a circuit (not shown) a lateral displacement of roll 5 and rollers 7 and 8 in a direction to compensate this staggering. In the event of lateral staggering of web 12, a corresponding correction is carried out in the same manner by device 16.

Suppose now that web 12 advances relative to web 11 to become longitudinally staggered as shown schematically, and in an exaggerated manner, at the left of FIG. 3. Cell 43 (FIG. 4) of device 16, which detects the discontinuities of the imprint 38, will be activated before the corresponding cell of device 15 since web 11 has a lag relative to web 12. There will thus be a time difference $\Delta t$ between the signals given by the two cells. As a function of this time difference $\Delta t$, device 16 controls its electronic circuit (not shown) in a manner so that the tension applied to web 12 by rollers 9, 10 is increased to pull the paper until the time difference drops to zero, or in other words until the cells of devices 15 and 16 read the discontinuities simultaneously and the patterns on webs 11 and 12 once more register exactly.

If for any reason whatsoever, for example an unusual dilatation over a great length of web 11, the advance of web 12 and hence the staggering between the two webs is maintained and possibly increases, the tension exerted on web 12 will increase to reach the maximum tension $T_{max}$ close to the breakage tension of the web. The control device 18 will react to this tension $T_{max}$ and may hence actuate the warning signal or stop the machine. However, before this warning signal or stopping of the machine, the above-mentioned complementary switching function can be applied. As stated above, initially the webs 11 and 12 were both placed under the mean tension $T_m$. Before stopping the machine at the moment when web 12 reaches tension $T_{max}$, it is possible to reduce the tension of web 11 down to the minimum tension in order to take up the staggering. The control device 18 may thus be used to control rollers 7,8 by an electric circuit (not shown) to reduce the tension of web 11 to further reduce staggering between the two webs 11 and 12. At the moment when the tension of web 11 once more increases to reach mean tension $T_M$, the control device once more switches the circuit (not shown) so that device 16 once more directly controls rollers 9, 10. If it is web 11 that has an advance in relation to web 12 and hence a staggering, the device 15 will control an increase of the tension of web 11 as previously described, with a similar possibility of switching.

Of course, the above-described machine is only given by way of example. It would be possible to provide a computer for taking up any staggering while varying the tensions of webs 11 and 12 the least possible. Any correction will thus be double, i.e. the tension of one web will be increased and that of the other reduced.

In a simplified version, one of the webs would be held at mean tension $T_M$, while the tension of the other web only is varied between the limits $T_{min}$ and $T_{max}$.

A single cell could replace the cells 41 and 42 (FIG. 4) of the devices 15 and 16, this single cell being set to follow the outer edge of the reference imprint 39.

The reference imprint 39 could be replaced by magnetic means consisting of a magnetic imprint or band applied to the edges of the webs to be joined, for example a magnetic material such as cobalt oxide, and which carries the required information.

Figure 5:
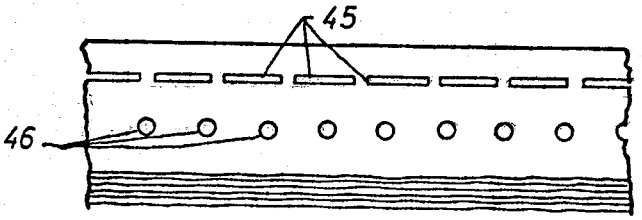
FIG. 5 shows in detail the edge of a standard-width web in which the reference marks are not an optical imprint as schematically shown on FIG. 4, but perforations for reading by pneumatic means.

The guide and reference imprint can also be replaced by pneumatic means, such as those shown in FIG. 5, which can be read by a well-known type of pneumatic logic device, not shown. The pneumatic means shown consist of a succession of small dash-like perforations 45 forming a line for control and correction of the lateral position of the web, and a succession of spaced-apart circular perforations 46 enabling control of the longitudinal position of the web.

Also, simplifications can be made in the case when the transfer pattern has only longitudinal lines or stripes or even a uniform pattern. In this case, only lateral registering means need be provided.

FIG. 6 shows a pair of rollers adapted to be mounted on the machine to form a varied means for lateral correction of a web. It suffices to pass a web 47 about two parallel cylinders 48, 49 mounted on a chassis (not shown) arranged to turn the cylinders through an adjustable angle $\alpha$ to a line perpendicular to the direction of feed of web 47. Each value of angle $\alpha$ corresponds to a value D of a lateral displacement of the web. The arrangement of FIG. 6 can be incorporated in the machine of FIGS. 1 and 2. A modified arrangement could alternatively have a simple chassis able to be moved laterally.

Figure 7:
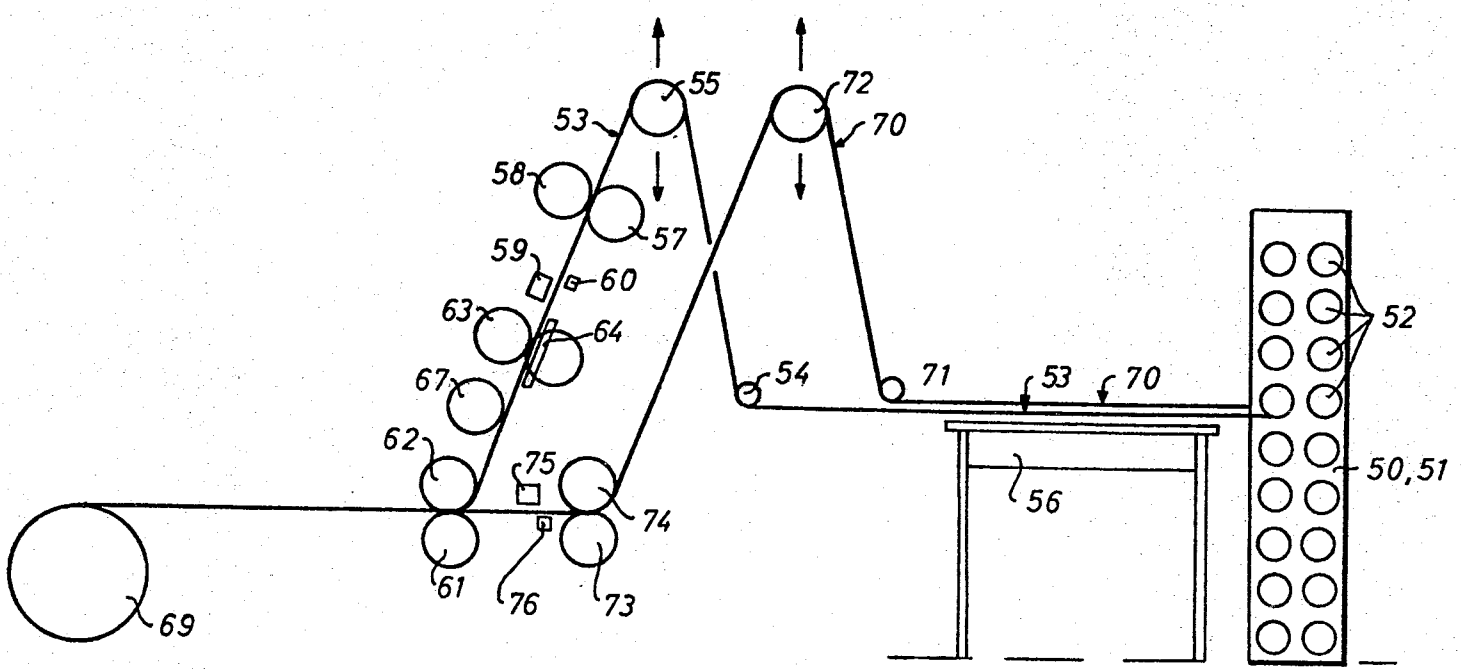
FIG. 7 is a side view of a variation of the embodiment of FIGS. 1 and 2.

FIG. 7 shows a varied machine in which a composite wide band assembled from two printed webs is simply wound onto a take-up roll for later use. FIG. 8 is a plan view showing the part of the machine of FIG. 7 where the webs are stuck together. The machine of FIG. 7 comprises two endless-chain elevators 50, 51 carrying standard-width printed rolls 52. From one of rolls 52 is unwound a web 53 passing about a freely-turning cylinder 54 and an "accumulation" cylinder 55 making the web 53 pass along a loop enabling the machine to remain in operation when the roll 52 is empty and must be changed. Upon change of the roll, the rear end of the web 53 of one roll is manually adjusted on table 56 and stuck to the front end of the web of the following roll 52. During the time required for this adjusting and sticking, the cylinder 55 moves down and the machine is fed by the reserve formed by the loop about cylinder 55. Table 56 is provided with cutting and sticking means for carrying out the operations mentioned above. After cylinder 55, web 53 passes between a pair of tension rollers 57, 58 similar to those of FIGS. 1 and 2, and controlled by a guiding and registering device 59 also similar to that described with reference to FIGS. 1 and 2. A web-tension control device 60 is also provided for the same function as that described with reference to FIGS. 1 and 2, and the web 53 passes between a pair of driving rollers 61, 62 rotating at constant speed. Between rollers 61, 62 and the device 59 is a circular cutter 63 rotating against a bearing wheel 64, for cutting the web 53 before assembly with a second web 70.

The second web 70, delivered from a roll 52 of the elevator 51 placed behind elevator 50, passes about an accumulation cylinder 72 similar to cylinder 55, between a pair of tensioning rollers 73, 74 and then between drive rollers 61, 62 common to the two webs 53 and 70. As for web 53, web 70 is controlled by a guide and registering device 75 and a tension control device 76. Between device 75 and rollers 61, 62 is placed a wheel 67 applying a thin coat of adhesive 68 to the edge of the web. FIG. 8 is a plan view of webs 53 and 70 in the installation of FIG. 7, at the location where the webs are stuck together. Thus, only one of the webs is cut, namely web 53, and the non-patterned edge of the other web 70 is not cut, as in the embodiment of FIGS. 1 to 3, but receives a thin film 68 of adhesive applied by wheel 67, this adhesive-coated edge directly receiving web 53 pre-cut by circular cutter 63. The cut edge 77 of web 53 is deviated out of the machine by guide means, not shown. When the two webs pass between cylinders 61, 62 they become stuck together. The sticking together is carried out with the pattern in perfect register since the guide and registering devices 59 and 75 are placed before the locations of the cutting and sticking operations. Finally, it is noted that the devices 59 and 75 of the machine of FIG. 8 have only two cells, one cell 78 or 79 respectively serving to follow a respective line 80, 81 of the reference imprint, and a second cell 82, 83 respectively serving to read respective reference points 84, 85 regularly spaced apart along the longitudinal direction. After having passed between cylinders 61 and 62 where they are stuck together, the united webs are wound up on storage roll 69. Apart from the above-described differences, i.e. cutting of only a single web, sticking the cut edge of this web on the edge of the other web, and storage of the composite wide band formed on roll 69, the machine of FIG. 7 operates in the same manner as that described with reference to FIGS. 1 and 2. All of the variations described for the embodiment of FIGS. 1 and 2 may also be made to or incorporated in the machine of FIG. 7.

An important advantage of the arrangement of FIG. 7 is that the machine can operate continuously, i.e. without stoppages for loading it, since the cylinders 55 and 72 enable the operator to carry out joining of the ends of successive webs on the table 56.

To persons skilled in the art it will be clear that the machines of FIGS. 1 to 8 can undergo important changes or simplifications. For example, the cutting operation can be carried out before placing the webs in the machine, which need thus not include a cutting device. Several arrangements of machines without a cutting device can be envisaged. One possibility would be to trim the edges of one web, for example web 53 in the embodiment of FIG. 7, after printing and before winding on rolls 52, the web 70 not being cut. The machine of FIG. 7 would thus not include a cutting device 63, 64 and the registering device would be placed at the other side of web 53, facing its non-cut edge which could carry reference marks. Another possibility, in the case of a simple pattern, for example a single color imprint without a design or a pattern of longitudinal lines or stripes for which only lateral setting is necessary, would be to cut the webs 53 and 70 (FIG. 7) on each side after printing and before supplying them to the machine, which would also not have any cutting device. The setting means would thus be simplified since their function would be limited to setting laterally by means of a single cell following one of the pre-cut edges of one or both webs. It is clear that when the cutting operation is carried out before introducing the webs into the machine, it should be carried out carefully and after location of reference marks, unless the print is uniform without any design.

Also, it will be evident to persons skilled in the art that the sticking operation can be dispensed with when the large-width transfer paper produced is directly fed into a transfer machine, as in FIGS. 1 and 2, so long as the pattern to be registered is not too complex so that very slight displacements of one web relative to the other can be tolerated. Such arrangements are illustrated in FIGS. 9, 10 and 11. FIG. 9 is a plan view of part of a machine in which registering is carried out, by means of devices as described with reference to FIGS. 1 to 8, before driving rollers 90. The machine partly shown in FIGS. 9 and 10 is arranged to assemble three webs 91, 92, 93 and deliver them directly to a transfer machine 94 with a substrate (not shown) to be printed. Before reaching rollers 90 the webs 91, 92, 93 are disposed at different heights and arrive between rollers 90 at different angles to the horizontal, as shown in cross-section in FIG. 10, one of the edges 94, 95, 96 of the webs having been cut, after detection of register marks, either in the machine by means of cutting devices not shown, or before introduction of the webs into the machine. The non-cut edges 97, 98, 99 have reference imprints which pass facing registering devices 100, 101 and 102 similar to those described with reference to FIGS. 1 to 8, 103, 104 and 105 designate printed patterns on the webs extending up to the cut lateral edges 94, 95, 96. The machine of course has means (not shown) for guiding and tensioning the webs, similar to the means described with reference to FIGS. 1 to 8, these means being connected to registering devices 100, 101 and 102. The webs 91, 92 and 93 are hence guided and positioned relative to one another before entering the transfer machine 94 which is placed immediately after drive rollers 90. With this machine, it is possible to laterally and longitudinally position the three webs relative to one another, web 92 being positioned relative to web 91, and web 93 relative to web 92, before delivering them without sticking into the transfer machine 94.

In the varied arrangement of FIG. 11, webs 91 and 93 are fed in the same plane to the driving rollers 90, whereas the feed of web 92 between rollers 90 is in a plane at a greater angle to the horizontal. In this arrangement, webs 91 and 93 are not cut, while the two edges of web 92 are cut after detection of the reference marks, either in the machine, or before introduction into the machine. The printed patterns on the webs are designated by 106, 107 and 108. Facing the edges 109 and 110 of webs 91 and 93 are located simplified registering devices 111 and 112 which serve to locate the reference marks and control lateral displacement of the webs. Facing the cut edge 113 of web 92 is a registering device 114 following the cut edge 113. This simplified variation of FIG. 11 is used to position webs whose pattern requires only lateral guiding.

For very regular patterns, such as squares or crossing parallel lines, it is possible to use the pattern as a reference, instead of providing separate reference imprints. In this case, all of the webs can be trimmed along both edges in the machine or before introduction in the machine, the registering devices being placed directly facing the pattern, to follow lines or well-defined areas of the pattern.

Figure 12:
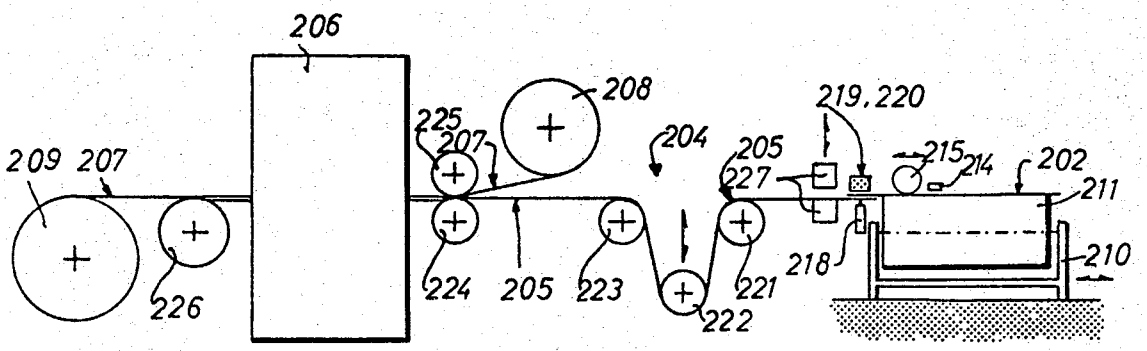
FIG. 12 is a schematic side view of a second embodiment of a machine for forming a composite band of transfer paper from sections of an initial web of transfer paper fed perpendicular to the band being formed by means of a transverse conveyor.
Figure 13:
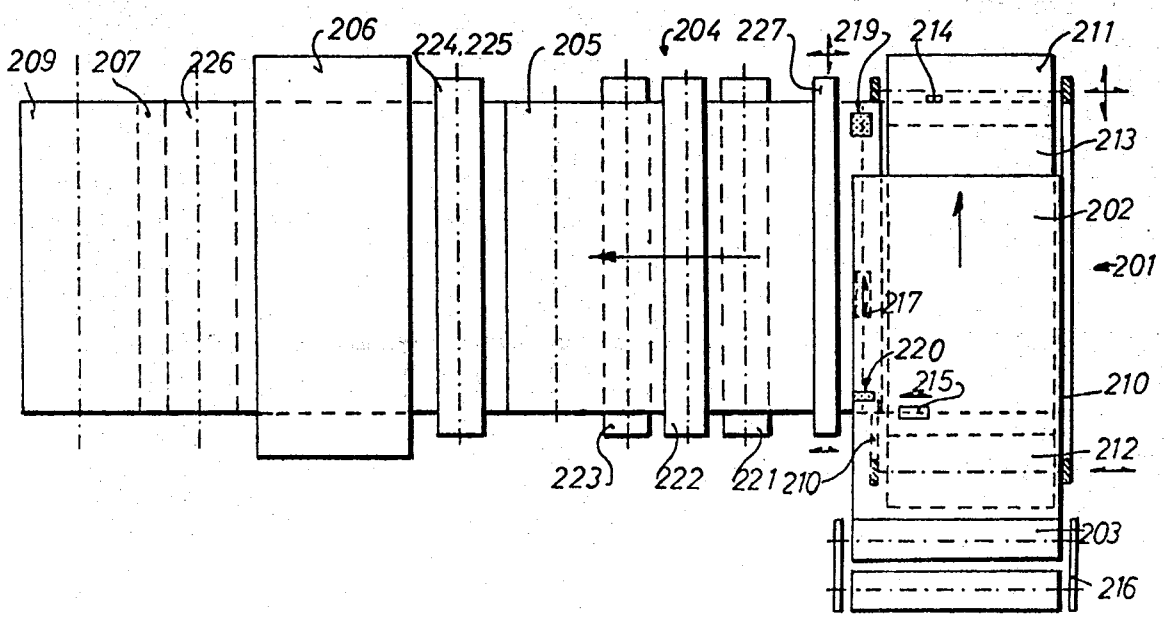
FIG. 13 is a plan view of the machine of FIG. 12.

The machine shown in FIGS. 12 and 13 comprises a transverse conveyor 201 for feeding an initial web 202, of printed transfer paper for example, from a feed roll 203, perpendicular to a delivery conveyor 204 arranged to deliver a band 205 formed of assembled sections of web 202 to a transfer machine 206 where the band 205 passes between two cylinders (not shown) with a material 207 to be printed fed from a feed roll 208 and wound at the delivery of the machine on a take-up roll 209.

The transfer machine 206 enables transfer by sublimation or decalcomania of the printed pattern from the transfer paper to the material 207 at a temperature of about 240° C. As these transfer machines are well known to persons skilled in the art, the machine 206 will not be described in detail.

The transverse conveyor 201 comprises a chassis 210 at the ends of which are two rotatable cylinders 211 and 212. An endless belt 213 passing about cylinder 211, 212 delivers the initial web 202 of transfer paper from feed roll 203 until the front end of web 202 abuts against a stop 214 in the path of feed of web 202, whereupon belt 113 stops. On conveyor 201 is mounted a transversally-moving cutter 215 for cutting a section of web 202 for assembly with band 205.

Feed roll 203 is contained in a feed magazine 216 in the form of an elevator containing an endless chain or magazine of supply rolls which are successively placed in front of conveyor 201. At the left hand side of conveyor 201 is slidably mounted a cutter 217 for cutting the overlapping edges of web 202 and band 205 simultaneously after they have been set relative to one another, as well as a roll 218 (FIG. 12) of an adhesive band for sticking together the two edges after cutting.

Between transverse conveyor 201 and delivery conveyor 204 are mounted registering devices 219, 220 operation of which will be described later with reference to FIGS. 17 to 20.

The delivery conveyor 204 includes an accumulator formed of three rollers 221, 222, 223, the roller 222 being arranged to move vertically to build up a reserve of the band in the form of a loop. Band 205 which passes over roller 221, about roller 222 and over roller 223 is fed, with the material 207 to be printed, between two drive rollers 224, 225 rotating at constant speed to transfer machine 206 at a regular speed. After passage with material 207 through transfer machine 206, the used band 205 is wound on a roll 226.

Between roller 221 and conveyor 201 is a mobile gripper 227 arranged to hold the end of band 205 and position it relative to registering devices 219, 220 before positioning of the web section 202 by means of conveyor 201. Operation of gripper 227 will be described in detail later, with reference to FIGS. 17 to 21.

Figure 14:
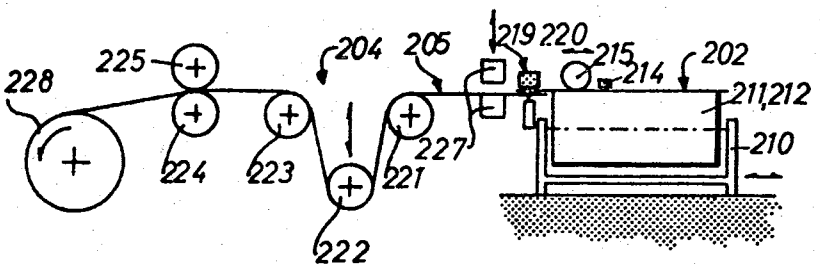
FIG. 14 is a side view of a variation of the machine of FIG. 12.
Figure 15:
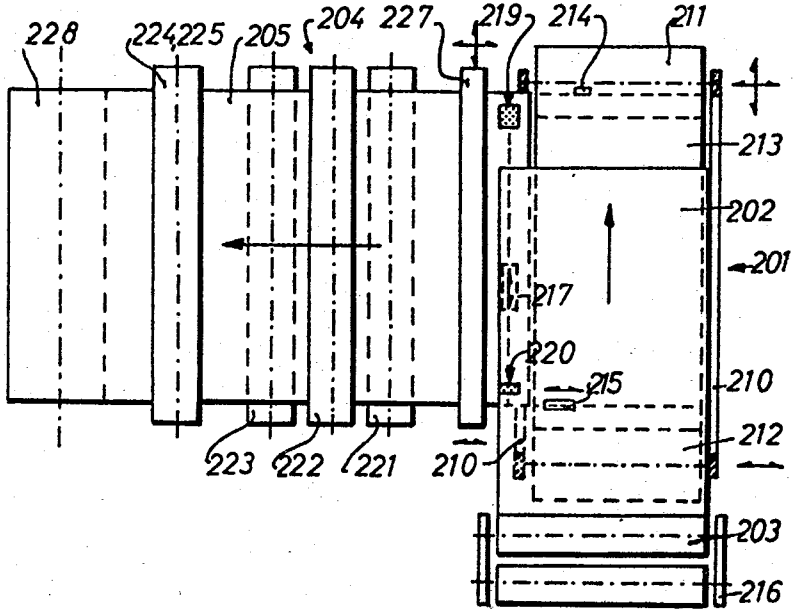
FIG. 15 is a plan view of the variation of FIG. 14.

The machine shown in FIGS. 14 and 15 is similar to that of FIGS. 12 and 13, the band 205 assembled from sections of the initial web however being wound on a storage roll 228 for later use. The machine of FIGS. 14 and 15 thus does not include transfer machine 206 and the feed and take-up rolls 208, 209 of material 207 to be printed. Apart from this detail, all of the components of the embodiment of FIGS. 12 and 13 are incorporated in the machine of FIGS. 14 and 15, and are designated by the same reference numerals.

FIG. 16 schematically shows the manner in which the transverse conveyor 201 can be displaced to position the web-section it carries relative to the registering devices. The conveyor 201 can move in two mutually perpendicular directions indicated by arrows 228 and 229, and can turn about a pivot 230 through an angle $\alpha$ relative to the direction of arrow 229.

FIG. 17 shows a section 231 of paper, its printed part being shown by the partially hatched area 232 which extends beyond dashed lines 233, 234 representing the lines of cutting during assembly. On the non-printed edges 235, 236 respectively of section 231 are rectangular reference imprints 237, 238, 239 and 240, 241, 242. The reference imprints 237, 238 and 239 are symmetric to imprints 240, 241 and 241 about the long axis of section 231. Imprints 237 to 242 suffice to position section 231 relative to the sections (not shown) preceding and following section 231. However, it can happen that the paper of one of the sections stretches or retracts slightly relative to the other sections. In this case, it is necessary to place the sections under an adjusted tension to elongate them and hence compensate for a difference of length. For this purpose, an additional imprint 243, 244 respectively is provided on edges 235, 236 of section 231. The exact function of the reference imprints 237 to 244 will be described later with reference to FIGS. 18 to 20. Of course, the imprints 237 to 244 must be in correspondence with the pattern printed on the transfer paper, and the pattern must repeat along the web between imprints 237, 240 and 239, 242. Also, the pattern in the proximity of line 233 must be able to be superimposed on that in the proximity of line 236 of each section 231. The pattern will be registered longitudinally, i.e. in the direction of arrow 245, by imprints 237, 240 and 243, 244, and laterally, i.e. in the direction of arrow 246, by imprints 238, 239 and 241, 242.

Figure 18:
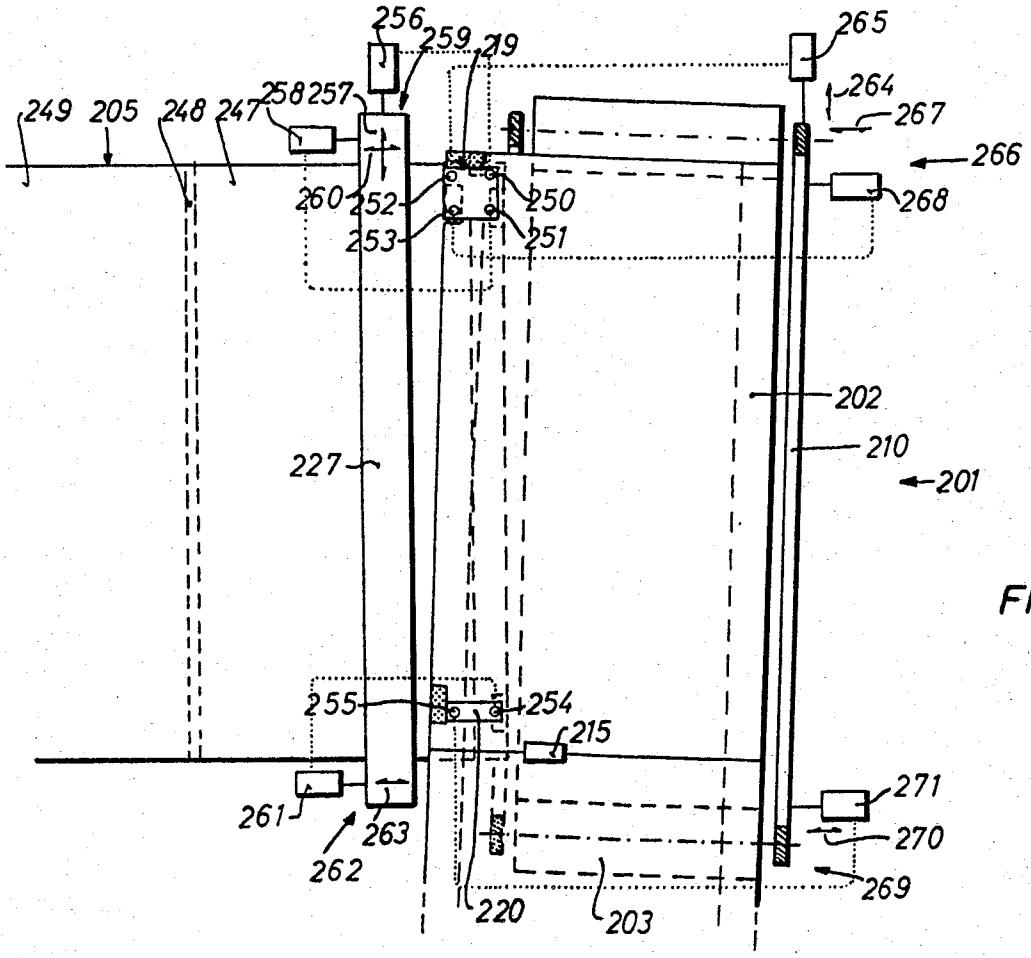
FIG. 18 is a plan view of a detail of a transverse conveyor and the end of a band formed of assembled sections of an initial web, with devices for detecting reference marks and means for controlling setting.
Figure 19:
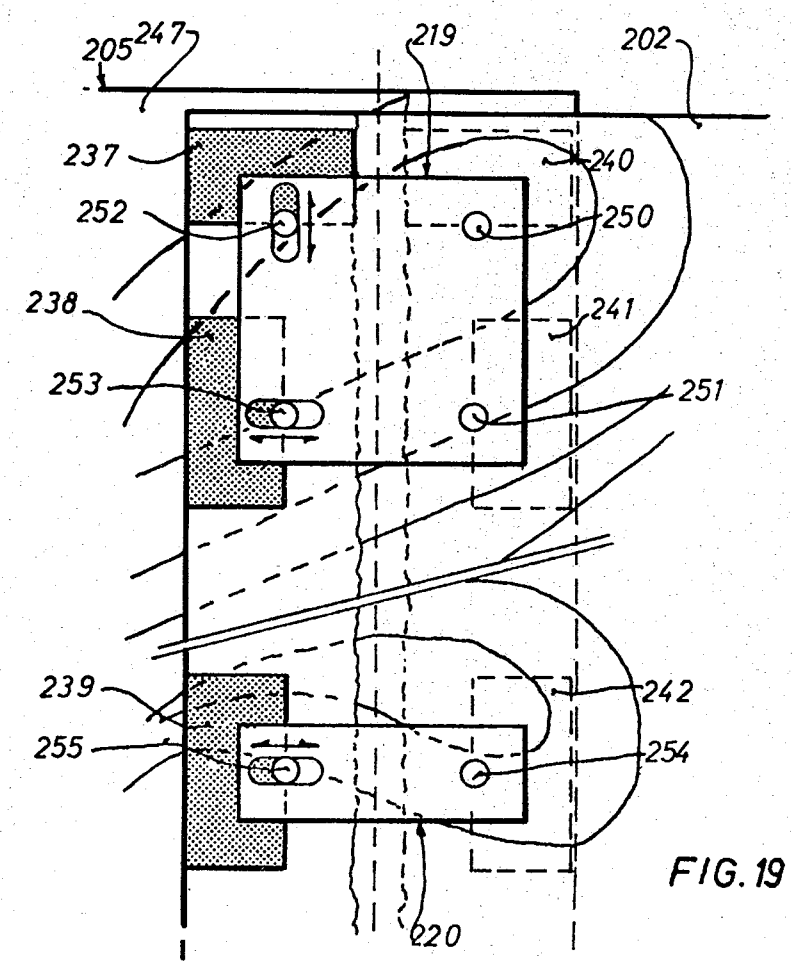
FIG. 19 is a detailed view showing the assembly of the end of a band formed with an edge of an initial web section, the reference-mark detecting devices being shown in position over the reference imprints on the band and section.
Figure 20:
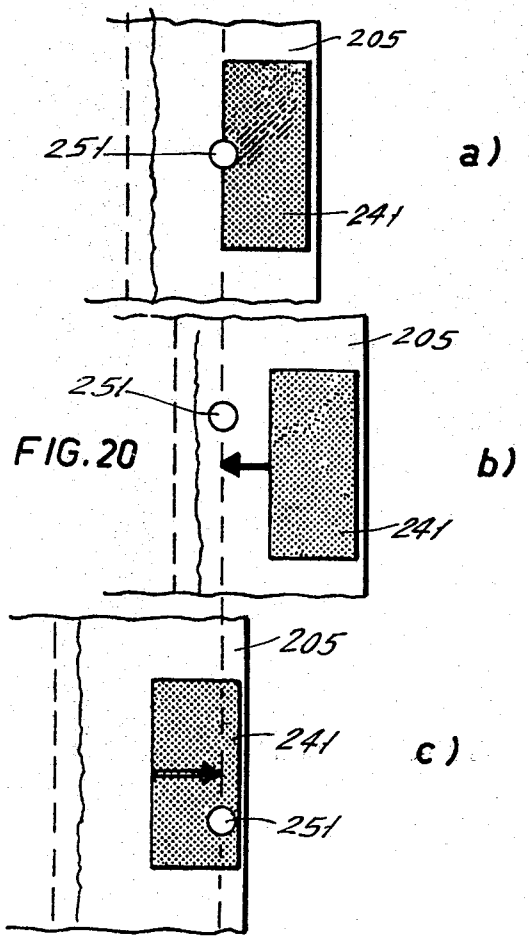
FIGS. 20*a, b* and *c* illustrate operation of the registering devices.

Considering now FIGS. 18, 19 and 20, FIG. 18 shows an enlarged view of the positioning arrangement of FIGS. 12 to 15, with the chassis 210 of conveyor 201 delivering an initial web 202 from which a section is cut by cutting device 215. The band 205 formed from sections 202 is held in place in the positioning gripper 227. The last section 247 held in gripper 227 is stuck along its underside to the preceding section 249 by an adhesive strip 248. The two registering devices 219 and 220 respectively have four photoelectric detectors 250, 251, 252, 253 and two photoelectric detectors 254, 255. Detectors 250 to 255 are small diameter detectors each containing a light source and a photoelectric cell. The detectors 250, 251 and 254 are intended to position the section 247 at the end of band 205 being formed. Detector 250 controls a motor 256 arranged to longitudinally displace gripper 227 according to arrow 257. Detector 251 controls a motor 258 arranged to laterally move the end 259 of gripper 227 according to arrow 260. Detector 254 controls a motor 261 arranged to laterally displace the other end 262 of gripper 227 according to arrow 263.

Detectors 252, 253 and 255 are intended to position the section 202 delivered by conveyor 201. In particular, detector 252 moves conveyor 201 longitudinally according to arrow 264 by means of a motor 265. Detector 253 moves the end 266 of conveyor 201 laterally according to arrow 267 by means of a motor 268, and detector 255 moves the end 269 of conveyor 201 laterally according to arrow 270 by means of a motor 271.

By means of detectors 250 to 255 and motors 256, 258, 261, 265, 268 and 271 it is possible to firstly position the end of band 205 being formed, in relation to detectors 250, 251 and 254 of devices 219 and 220, and then section 202 in relation to detectors 252, 253 and 255 of the same devices 219, 220. As these reference devices 219 and 220 are fixed, the section 202 will be exactly positioned relative to the end of band 205. The detectors 252, 253 and 255 may be adjusted in the device 219 and 220 relative to detectors 250, 251 and 254. It is hence possible to regulate the devices 219, 220 as a function of slight errors of positioning the reference imprints which may occur when adjusting the printing presses used to print the web 202 of transfer paper.

FIG. 19 also shows the register imprints 237, 238, 239 and 240, 241, 242 printed on the edges of web 202 and band 205, these imprints being shown in the adjusted position. It is observed that in the adjusted position, these imprints "cut" the detectors in half, i.e. in this position (see FIG. 20*a*), a signal of 50% of the maximum intensity is delivered to the respective motor which stops. In case a detector is directed at paper beside the reference imprint, the detector supplies a 100% signal and the respective motor is actuated to move the paper (towards the left in the example of FIG. 20*b*) upon reception of such a signal. When a detector is directed exactly facing a reference imprint which is printed in a dark color, for example blue or black, the detector gives a 0% signal and the respective motor is actuated to move the paper (towards the right in the example of FIG. 20*c*) upon reception of such a signal.

The reference imprints are arranged in such a manner that each detector detects and controls correction in only one direction. Imprints 237, 240 control longitudinal positioning while imprints 238, 239 and 251, 254 control lateral positioning.

Figure 21:
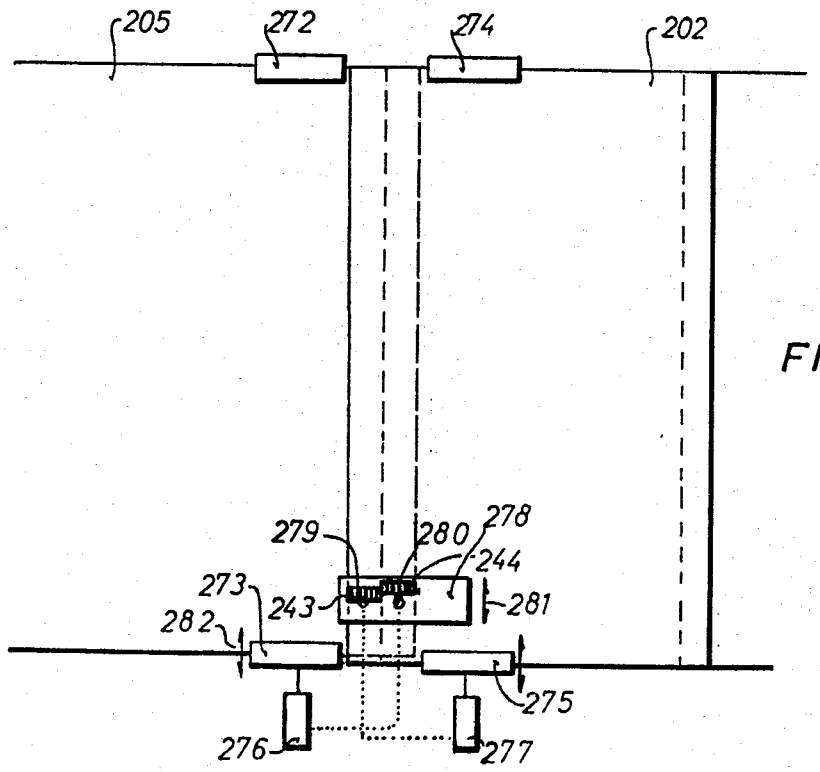
FIG. 21 shows an additional transverse registering device enabling the tension of each web section to be set to obtain perfect superimposition of the patterns.

FIG. 21 shows additional positioning means that can complement the above described means. It can be seen on FIG. 19 that only a single mark (i.e. reference imprint 237, 240) is provided for controlling the longitudinal position of each of the web 202 and band 205. Now, it can happen that the paper extends or retracts so that if the positioning is correct at the end of the paper near imprints 237 and 240, it may not be correct at the other end.

To remedy this, the additional registering device of FIG. 21 is provided. Two pairs of grippers 272, 273 and 274, 275 are provided for gripping adjacent edge parts at the ends of band 205 and web section 202. Grippers 272 and 274 are fixed, and grippers 273 and 275 controlled by respective motors 276, 277 are arranged to tension band 205 and section 202. A registering device 278 comprising two detectors 279, 280 is placed in the proximity of additional imprints 243, 244 provided on the paper described with reference to FIG. 17. The device of FIG. 21 operates as follows:

After detection has been carried out by means of the devices 219, 220 (FIG. 19), the grippers 272 to 275 close and grip the paper. The additional device is movable according to arrow 282 of FIG. 21 and is placed in such a manner that it is necessary to slightly tauten the paper to bring the additional imprint 244 of the end of band 205 exactly onto the middle of detector 280. Detector 280 hence controls motor 276 to actuate gripper 282 until imprint 244 arrives at detector 280. At this moment, motor 276 stops. Likewise, detector 279 acts on motor 275 to bring the additional imprint 243 to detector 279. Once this is done, the patterns are in perfect register even if dilatations of the paper had occured. The paper can then be cut and the adhesive band stuck on to unite band 205 and web section 202.

Of course, details of the additional device of FIG. 21 may be modified. For example, the band 205 can be placed under a predetermined tension by means of grippers 272 and 273 and motor 276, and device 278 be moved according to arrow 281 until detector 280 arrives over the additional imprint 244. The grippers 274, 275 will then be actuated to bring imprint 243 under the detector 279. The grippers 272 and 273 can be formed by jaws on the gripper 227 of FIGS. 12 to 15, 18 and 19. Finally, grippers 274 and 275 may be mounted on the transverse conveyor.

The embodiment described with reference to FIGS. 12 to 21 operate as follows:

An initial web, 202 for example of printed transfer paper, is fed from roll 203 by the conveyor 201 to face and overlap the band 205 being formed. As soon as web 202 contacts stop 214, forward movement of conveyor 201 is stopped and web 202 is cut by cutter 215 to form a section to be joined to band 205. During feed of web 202 on conveyor 201 the end of band 205 is positioned by devices 219 and 220. For this operation, gripper 227 closes on the end of band 205 and the detectors 250, 251 and 254 (FIG. 18) of the devices 219 and 220 act to position the imprints 240, 241 and 242 (FIG. 19).

It was seen in conjunction with FIG. 20 that if the detectors face, for example, a non-printed part, the paper will be moved to the position shown in FIGS. 20*a* (and 19). Positioning begins with a longitudinal adjustment, i.e. by moving imprint 240 relative to detector 250. As shown in FIG. 18, detector 250 controls motor 256 to longitudinally move gripper 227. As soon as imprint 240 is placed relative to detector 250, lateral positioning is carried out by means of detectors 251 and 254. Detector 251 controls lateral displacement of the end 259 of gripper 227 by means of motor 258, and detector 254 controls lateral displacement of the other end 262 by means of motor 261. As soon as this operation is terminated, positioning of web section 202 is carried out by detectors 252, 253 and 255 which respectively control motors 265, 268 and 271 to shift transverse conveyor 201, as previously described. When web section 202 is correctly placed relative to band 205, as shown in FIG. 19, the band and section are cut by the cutter 217 shown in FIGS. 12 to 15, and the trimmings are removed by means not shown. Immediately after cutting, an adhesive strip from roll 218 is applied on the lower face of the edge-to-edge joint. The adhesive strip must be as thin as possible and have a coefficient of dilatation substantially equal to that of the transfer paper. To avoid creation of a heat barrier when the transfer paper passes through transfer machine 206, it is possible to use a perforated adhesive strip. Once application of the adhesive strip from roll 218 is completed, gripper 227 opens and band 205 advances a conveyor 204 by the width of a strip 202, for the next step to be carried out.

It is to be noted that the driving rollers 224, 225 rotate at constant speed and hence drive band 205 at constant speed. This is important, since the band 205 in contact with material 207 to be printed must not stop in the transfer machine 206. Even in the varied form of machine of FIGS. 14 and 15 where the band 205 is simply wound on storage roll 228, it is desirable not to stop this storage roll, but that winding of the band 205 on the roll should be carried out in a continuous manner. In this way, unwanted tensions which could at the limit rip the band of transfer paper are avoided. As the operation of registering and sticking together the initial web section is intermittent, the accumulator device schematically shown in FIGS. 12 to 15 by rollers 221, 222 and 223 is provided. While adjusting and sticking of the band and web section take place, the roller 222 moves slowly up from its lowermost position and hence permits the machine to operate continuously. When the sticking operation is completed, and the band 205 moves forward by the width of a web section, this length accumulates in the loop by downward movement of roller 222. Sticking of the following section 202 can then be carried out.

In case differences in adjustment due to dilatation of the paper are observed, the additional device of FIG. 10 can be brought into action.

Of course many modifications of details can be made to the arrangements described with reference to FIGS. 12 to 21. For example, the described reference marks formed by imprints could be replaced by magnetic data carried on or in the paper, or by pneumatically-detectable data marks such as perforations along the sides of the paper. For magnetic reference marks, the registering devices 219, 220 would include magnetic reading heads. For reference marks in the form of perforations, the registering devices would include pressure detectors.

The embodiments of FIGS. 12 to 21 enable a very precise registering of the imprints during formation of the band 205. Of course, it will be apparent to persons skilled in the art that these embodiments may be considerably simplified.

Figure 22:
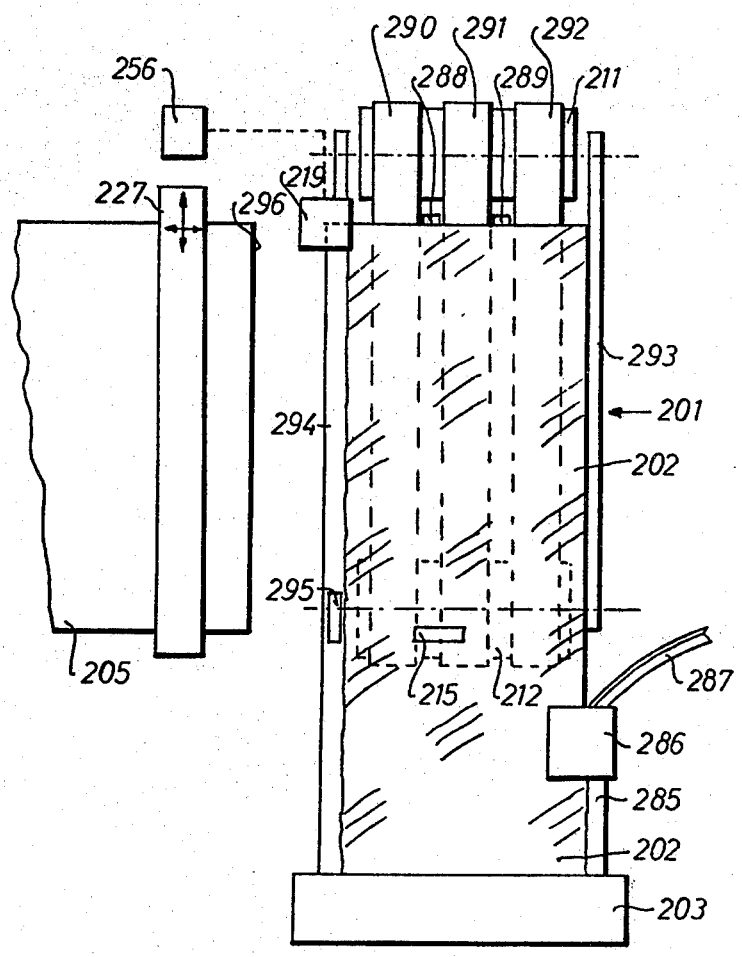
FIG. 22 is a plan view of a variation of the machines of FIGS. 12 to 21.

For example, as shown in the varied embodiment of FIG. 22, it is possible to deliver a web 202 onto conveyor 201 from a roll 203, with one of the edges 285 of the web being pre-cut after detection of reference marks, by a device 286. The cut edge 287 is removed as shown. Web 202 is fed by conveyor 201 until its front end contacts stops 288 and 289, whereupon conveyor 201 stops. The web 202 is supported on conveyor 201 by endless belts 290, 291, 292 turning about cylinders 211, 212. A cutting device with detection means 215 cuts web 202 which is held and positioned on conveyor 201 during feed by, for example, pneumatic means (not shown) so that it comes to contact stops 288, 289 on the one hand and a wall 293 on the other hand. As the two perpendicular edges of web 202 bearing against stops 288, 289 and wall 293 have been cut after detection of reference marks (either reference imprints on the edges of the web or on the pattern itself), the cut web section occupies a well determined position. It therefore suffices to apply an adhesive on the non-cut edge 294 by means of a device 295, and deliver band 205 over edge 294 by means of gripper 227 controlled by motor 256. For this operation, there is provided a registering device 219 similar to that described with reference to FIGS. 12 to 21, for positioning the corner 296 of the rear end of band 205. The control of movement of gripper 227 by means of motor 256 will be regulated so that the end of band 205 is suitably positioned relative to web section 202 when its corner 296 is in place relative to device 219. The contacting edges of band 205 and web section 202 are then pressed together. The fact that edge 294 of web section 202 is not cut enables on the one hand this edge to be used for the sticking operation and, on the other hand, to use reference imprints thereon for the purposes of cutting the ends of sections 202 and adjusting the band 205. It will be apparent to persons skilled in the art that the arrangement of FIG. 22 can be further simplified. These simplifications depend mainly on the quality of the transfer paper, the complexity of the pattern on this paper, and the skill of operators. In simple cases, all of the registering devices with the exception of those used for cutting can be dispensed with, and positioning of web section 202 relative to band 205 carried out solely by stops 288, 289 and control of the feed of band 205.

In the varied arrangement of FIGS. 23 and 24, a web 202 of patterned transfer paper whose lateral edges have been trimmed after detection of reference marks is stored on a roll 300 fitted in a feed device 301 provided with an 'accumulation' device formed of three fixed rotatable cylinders 302, 303, 304 and two vertically movable cylinders 305, 306. Web 202 is intermittently driven and laterally positioned by a device 307 comprising a pair of cylinders at the delivery of feed device 301. Lateral positioning by device 307 is achieved by means of a cell 308 controlling the passage of one of the precut edges of web 202. A gripper 309 moving on a rail 310 comes to collect web 202 fed from the cylinders of device 307 to deliver it in an adjusted position on a pressure and suction table 311. The upper surface of table 311 has orifices 312 arranged to supply pressurized air during the delivery of web 202 to facilitate delivery, and to apply a suction to hold the delivered web 202 on the table. The gripper 309 is momentaneously stopped just before the end of the delivery path to permit a cutting operation by a cutting device 313 after detection of reference marks by a cell 314. When cutting is finished, gripper 309 continues to move up to a stop 315, and opens. The air current through orifices 312 is inverted so that web section 202 is held by suction on table 311.

The web section 202 is thus held on table 311 in an exactly adjusted position, since the web was guided laterally by cell 308, cutting was carried out at a location set by cell 314, and the gripper 309 opened after coming against the stop. During the delivering movement of gripper 309, on adhesive strip 316' from a roll 317' is unrolled onto the edge of web 202 and protrudes beyond this edge. The protruding part of strip 316' is intended to come to apply on the rearmost edge of the band 205 formed from the web sections 202. The band 205, as web 202, is driven intermittently by a mechanism 316 with a positioning device controlled by a cell 317 cooperating with a gripper 318 which holds the end of band 205. Mechanism 316 comprises a pair of cylinders 318' for delivering the band 205 by a predetermined amount after each sticking operation. To allow this, gripper 318 opens and mechanism 316 starts up. Band 205 passes between cylinders 318' until its rear end arrives facing cell 317 which controls stopping of mechanism 316 and closing of gripper 318. The rear end of band 205 will thus be exactly adjusted relative to the web section 202 on table 311. The delivery of the band 205 takes place at the same time as the delivery of web 202. When the two delivery movements are finished, a pressure lath 319 moves down and presses the two edges of web section 202 and band 205 against table 311, and they are stuck together by the adhesive band unwound and stuck onto web 202 as it was delivered. At the end of the sticking operation, the lath 319 moves back up, gripper 318 opens and the following delivery operation can be carried out. If desired, a photoelectric cell 320 controlling the positioning mechanism 316 with its two cylinders 318' can be added to control the position of the left hand edge of band 205. This cell 320 is only necessary if very precise positioning is required.

When a very great precision is not required, the cells 308, 317 and 320 can be dispensed with, as well as the positioning devices associated therewith. It is however recommendable to keep cell 314 for control of cutting.

The gripper 309 for pulling web 202 can be replaced by other delivery means, for example a cylinder of large diameter on part of which a band section can be wound. After the cutting operation, this cylinder would move down onto table 311, and roll to deposit the band section on the table. It would thus be possible to position the band section without cells, stops or other means.

It is noted for the embodiments of FIGS. 12 to 24 that the cutting operations may be carried out either in the machines or before the webs are introduced therein, and that sticking can be provided by means of an adhesive strip on cut edge-to-edge joints, or by means of an adhesive on overlapping edges of the web sections. Also, numerous detection and adjusting operations can be carried out by various devices suited to the desired precision of assembly.

The invention is thus not limited to the described embodiments and variations. Many changes, improvements and simplifications can be made within the scope of the appended claims. The invention provides a new process of manufacturing wide transfer paper bands by assembling narrower webs or web sections and adjusting the assembly so that the patterns carried by the narrow webs or web sections are in exact registration and can be continuously transferred onto a substrate. The invention also includes machines for carrying out this new process, and the composite bands obtained.

What is claimed is:

1. A process for the transfer printing of a substrate from opaque transfer webs of lesser width than said substrate, said transfer webs each having a straight edge and carrying transferable designs or patterns, said process comprising the steps of: aligning at least two transfer webs with their respective straight edges near and parallel to each other; feeding the thus aligned transfer webs, together with the substrate onto which the designs or patterns are to be transferred, into transfer means; and transferring the designs or patterns onto the substrate in the transfer means after previously adjusting the relative position of the webs in a direction parallel to said straight edges, utilizing registration means which are formed on said transfer webs but are separate from and non-transferable with said designs or patterns, in such a manner that the designs or patterns on each of said transfer webs are in register with each other during said transferring step.

2. A process according to claim 1, further comprising the step of cutting the edge of at least one of the webs before aligning the transfer webs edge-by-edge.

3. A process according to claim 1, further comprising the step of cutting the edge of at least one of the webs after aligning the transfer webs edge-by-edge.

4. A process according to claim 3, further comprising the steps of overlapping the respective adjacent edges of two transfer webs and cutting the overlapping edges after bringing the respective designs or patterns into registration.

5. A process according to claim 1, further comprising the steps of cutting at least one edge of at least one of the webs before the webs are aligned edge-by-edge, said cutting to be done at a predetermined position relative to the pattern, and using said cut edge as a reference edge for aligning the cut web in registration with the neighboring web.

6. A process according to claim 1, wherein said step of feeding the transfer webs comprises the steps of continuously feeding the webs in a first direction into said transfer means and under approximately a predetermined tension with the webs maintained parallel to one another, and wherein said step of adjusting the relative position of said webs comprises the step of continuously regulating the lateral position and the tension of at least one of the webs so as to maintain alignment of the respective designs or patterns on said webs.

7. A process according to claim 6, wherein the tension of one of the transfer webs is held substantially constant and the tension of at least one other transfer web is varied between predetermined limits.

8. A process according to claim 6, wherein the predetermined tension is a mean tension which is the arithmetic means of a maximum tension below the breaking tension of the webs and a selected minimum tension whereby the webs exhibit a substantially rectilinear profile, and wherein the tension of at least one of the webs varies between the maximum and minimum tensions to maintain the respective designs or patterns in registration.

9. A process according to claim 1, further comprising providing web reserves in the form of at least one loop, thereby to maintain web movement during attachement of the leading ends of successive webs to preceding webs.

10. A process according to claim 1, comprising the initial step of applying the design or pattern to the web and also applying optical registration marks to at least one of the edges of each transfer web at the same time as the application of the design or pattern to that web.

11. A process according to claim 1, wherein said substrate is 2 to 6 meters wide.

12. A process according to claim 1, wherein said designs or patterns are transferred onto said substrate at a temperature of 180°–240° C.

13. A process for forming a generally rectangular composite transfer sheet having a length which is greater than its width from a plurality of individual lengths of generally rectangular transfer paper each having a length which is greater than its width, the length of each of said lengths of transfer paper being approximately equal to the width of said composite transfer sheet, each of said individual lengths of transfer paper having a forward and a rear lengthwise edge and carrying transferable designs or patterns thereon, said process comprising the steps of:

(A) placing the forward lengthwise edge of a first length of transfer paper near and generally parallel to the rearward lengthwise edge of a second length of transfer paper;

(B) adjusting the relative position of said forward and rear edges of said first and second lengths of transfer paper, utilizing registration means which are formed on said transfer webs but are separate from and non-transferable with said designs or patterns, in such a manner that said designs or patterns carried thereon are in registry;

(C) connecting said first and second lengths of transfer paper; and (D) repeating said steps (A), (B) and (C) for each successive said length of transfer paper.

14. A process according to claim 13, further including the step of forming said plurality of individual lengths of transfer paper from an elongated roll of transfer paper by cutting individual lengths of transfer paper from said elongated roll.

15. A process for the transfer printing of a substrate comprising the steps of:

(A) forming a generally rectangular composite sheet having a length which is greater than its width from a plurality of individual lengths of generally rectangular transfer paper each having a length which is greater than its width, the length of each of said lengths of transfer paper being approximately equal to the width of said composite transfer sheet, each of said individual lengths of transfer paper having a forward and a rear lengthwise edge and carrying transferable designs or patterns thereon, said process comprising the steps of;

(1) placing the forward lengthwise edge of said first length of transfer paper near and generally parallel to the rearward lengthwise edge of a second length of transfer paper;

(2) adjusting the relative position of said forward and rear edges of said first and second lengths of transfer paper, utilizing registration means which are formed on said transfer webs but are separate from and non-transferable with said designs or patterns, in such a manner that the designs or patterns carried thereon are in registry;

(3) connecting said first and second lengths of transfer paper; and (4) repeating said steps (1), (2) and (3) for each successive said length of transfer paper;

(B) feeding said composite transfer sheet, together with said substrate, into transfer means; and (C) transferring said designs or patterns onto said substrate in said transfer means.

16. A process according to claim 15, wherein said step of forming a composite transfer sheet further includes the step of forming each of said individual lengths of transfer paper from an elongated roll of transfer paper by cutting individual lengths of transfer paper from said elongated roll of transfer paper.

* * * * *